US011167194B1

(12) United States Patent
Schmitt

(10) Patent No.: US 11,167,194 B1
(45) Date of Patent: Nov. 9, 2021

(54) GOLF TRAINING APPARATUS

(71) Applicant: Daniel E. Schmitt, Ponte Vedra Beach, FL (US)

(72) Inventor: Daniel E. Schmitt, Ponte Vedra Beach, FL (US)

( * ) Notice: Subject to any disclaimer, the term of this patent is extended or adjusted under 35 U.S.C. 154(b) by 0 days.

(21) Appl. No.: 17/133,797

(22) Filed: Dec. 24, 2020

(51) Int. Cl.
*A63B 69/36* (2006.01)

(52) U.S. Cl.
CPC ..... *A63B 69/3667* (2013.01); *A63B 2210/50* (2013.01); *A63B 2225/09* (2013.01)

(58) Field of Classification Search
CPC ..... A63B 69/3667; A63B 2210/50; A63B 2225/09
USPC ..... 473/139, 218, 257, 270, 272
See application file for complete search history.

(56) References Cited

U.S. PATENT DOCUMENTS 3,244,421 A * 4/1966 Hanna ..... A63B 69/3667 473/273
3,384,377 A * 5/1968 Stipp ..... A63B 69/3667 473/218
3,868,116 A * 2/1975 Ford ..... A63B 69/36211 473/218
5,083,789 A * 1/1992 Hickson ..... A63B 69/3667 473/272
5,162,028 A * 11/1992 Wilkinson ..... A63B 23/0458 108/65
6,019,685 A * 2/2000 Fonseca ..... A63B 69/36211 473/265
6,840,870 B1 * 1/2005 Froggatte ..... A63B 24/0003 473/265
8,465,399 B2 * 6/2013 Tommy, Jr. ..... A63B 21/0442 482/53
9,486,683 B2 * 11/2016 Goodgame ..... A63B 69/0002
2006/0046864 A1 * 3/2006 Pagano ..... A63B 69/3667 473/270

* cited by examiner

*Primary Examiner* — Nini F Legesse
(74) *Attorney, Agent, or Firm* — Mark D. Bowen, Esq.; Malin Haley DiMaggio & Bowen, P.A.

(57) ABSTRACT

A golf training apparatus is provided for placement in-between a golfer's feet while the golfer is swinging a club and hitting golf balls to provide both resistance and feedback on the application of ideal foot pressure and ideal lower body force in ideal directions during their golf swing. The apparatus is fabricated from two boards that are adjustably connected and slide along two slots to create different board length dimensions.

4 Claims, 6 Drawing Sheets

GOLF TRAINING APPARATUS

CROSS REFERENCE TO RELATED APPLICATIONS

N/A

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all rights whatsoever.

BACKGROUND OF THE INVENTION

1. Field of the Invention

The invention is a golf training and practice apparatus, and more particularly, to an apparatus that trains a golfer to correctly activate and use leg muscles while swinging a golf club to improve the user's overall golf swing.

2. Description of Related Art

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Various devices, systems and methods have been developed for the game of golf in an effort to improve one's skill level. The background art reveals devices for positioning a golfer's stance in relation to a ball to be struck and relative to the target. The background art, however, does not disclose a device that trains a golfer to use (and feel how to use) his/her leg and abductor muscles and feet in a manner that maximizes the power and efficiency of the golf swing.

U.S. Pat. No. 4,257,608 (Funk) discloses a "Golfer's Setup Device" comprising a pair of rulers, 40 and 80, mounted transversely to each other using an attachment that allows each ruler to slide along its length relative to the attachment. Two foot position and angle strips, 50 and 52, are slidably mounted on the main ruler. This device is highly flexible and the user must calculate or look-up several angles and distances, slide the rulers to numbers on scales in two dimensions, slide the two foot position indicators to numbers on scales, and set the angles of the foot position strips. The correct numbers and angles for each golf club or range of clubs must be entered and referenced in a table. The device disclosed by Funk has not gained widespread acceptance and use as it is limited assisting the golfer with alignment and aim.

U.S. Pat. No. 4,354,683 (Wooland) discloses a "Golfer's Stance Positioning Aid." The Woodland device is similar to Funk above, in providing a two-way slide connection between two transverse members, 10 and 12. Indicia on the transverse members are graduated in club numbers. It provides fine incremental adjustability, but again, it's utility is limited to alignment/positioning/aim.

Other training apparatus focus on proper ball position in relation to a player's stance: some such systems include a mat with a first set of markings and/or lines thereon for aligning a player's feet, which correspond with a second set of markings for aligning a golf ball. Other devices provide a T-shaped or cross-shaped device having a first elongated measuring stick having markings for aligning a player's foot, and a second elongated stick perpendicular to the measuring stick for aligning the ball. Other devices include an elongated aiming rod that is secured to the shoe of the player. Such mats, measuring stick devices, and aiming rods are designed to aid in a golfer's alignment but do not train a golfer to apply pressure/force into the ground through the feet and legs by squeezing.

U.S. Patent Application Publication No. 2009/0176595, to Hubley; U.S. Pat. No. 5,944,613 to Dubois; U.S. Pat. No. 5,398,937 to Regan; U.S. Pat. No. 4,583,739, to Kabbany; U.S. Design Pat. No. D272,379 to Cachola; and U.S. Design Pat. No. D239,726, to Wintering, all are directed to golf stance and ball alignment practice aids as well as golf swing training devices utilizing various alignment bars. However, none of these references can be used in the manner of the present invention.

The golf training devices of the background are all burdened by significant limitations and disadvantages as they do not allow a golfer to train to create interaction and resistance in the ground. Accordingly, there exists a need in the art for advancements in golf training devices that address the limitations and disadvantages of the background. More particularly, there exists a need for advancements in the art of golf training aids for apparatus and methods that allow the user to feel pressure in the ground in which to build a repeatable and effective golf swing. The overall combination of these features is nowhere disclosed in prior art, including the prior art cited above which appears to be representative of the general art in this area.

The art described in this section is not intended to constitute an admission that any patent, publication or other information referred to herein is "prior art" with respect to this invention, unless specifically designated as such. In addition, this section should not be construed to mean that a search has been made or that no other pertinent information as defined in 37 C.F.R. § 1.56(a) exists.

BRIEF SUMMARY OF THE INVENTION

In light of the disadvantages of the prior art, the following summary is provided to facilitate an understanding of the innovative features unique to the present invention. The present invention overcomes the limitations and disadvantages present in the art by providing a novel golf training apparatus which is placed in-between a golfer's feet in two alternate orientations while the golfer is swinging a club and hitting golf balls. The apparatus is fabricated from two boards that are adjustably connected and slide along two slots to create different board length dimensions. It is a primary object of the invention to solve the problem of golfers being unable to apply ideal foot pressure and ideal lower body force in ideal directions during their golf swing. The apparatus trains golfers to apply ideal lower body forces in ideal directions to improve both accuracy, power, and balance in the golf swing. When a player squeezes the apparatus with their legs and feet during the swing, resistance/pressure is created in the ground that allows the user to relax his/her upper body and better rotate the hips and upper body during the takeaway, transition, downswing, and impact. A secondary object of this invention to improve the golfer's stance by promoting the golfer to stand straighter (i.e., less knee bend). The invention also provides a method for aligning a golf shot with respect to a target in addition to aligning the golfer's stance with respect to the target and the ball.

Accordingly, it is an object of the present invention to provide advancements in the field of golf training aids.

It is another object of the present invention to provide a golf training apparatus which is placed in-between a golfer's feet while the golfer is swinging a club to improve the user's interaction with the ground.

Yet another object of the present invention is to provide such a golf training apparatus that can be used when hitting golf balls and is length-adjustable to suit the needs of golfers of any height, stature, and skill level.

Still another embodiment of the present invention relates to providing a golf training apparatus adapted to address the flared-foot stances.

It is another aspect of the present invention to provide such a golf training aid that may be configured to a compact configuration which allows the golfer to easily carry and store the invention, enhancing the portability option.

This summary is provided merely for purposes of summarizing some example embodiments, to provide a basic understanding of some aspects of the subject matter described herein. Other features, aspects, and advantages of the subject matter described herein will become apparent from the following Detailed Description, and Claims.

BRIEF DESCRIPTION OF THE SEVERAL VIEWS OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
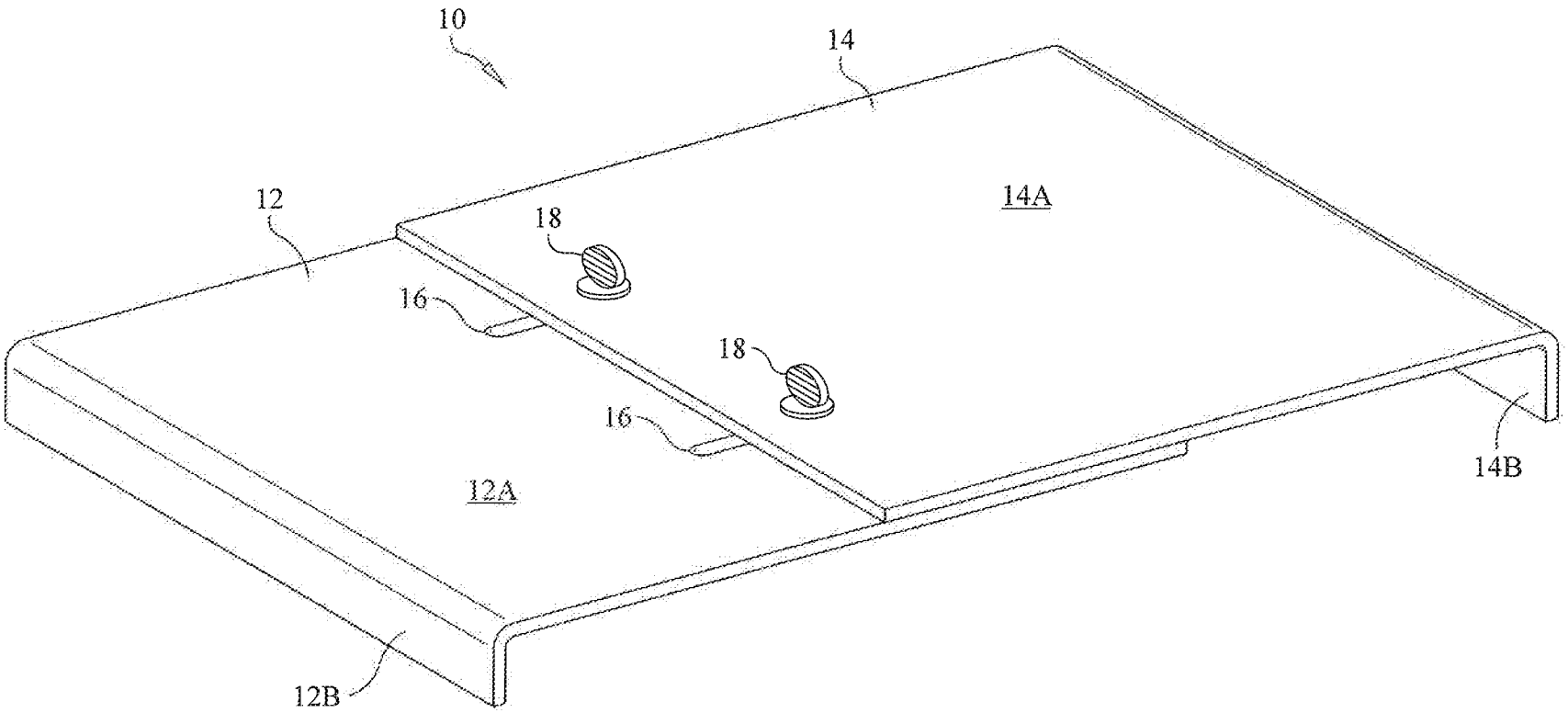
FIG. 1 is a top perspective view of a golf training apparatus in accordance with the present invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention. The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims.

In describing this invention, the word "coupled" is used. By "coupled" is meant that the article or structure referred to is joined, either directly, or indirectly, to another article or structure. By "indirectly joined" is meant that there may be an intervening article or structure imposed between the two articles which are "coupled". "Directly joined" means that the two articles or structures are in contact with one another or are essentially continuous with one another. By adjacent to a structure is meant that the location is near the identified structure.

Figure 2:
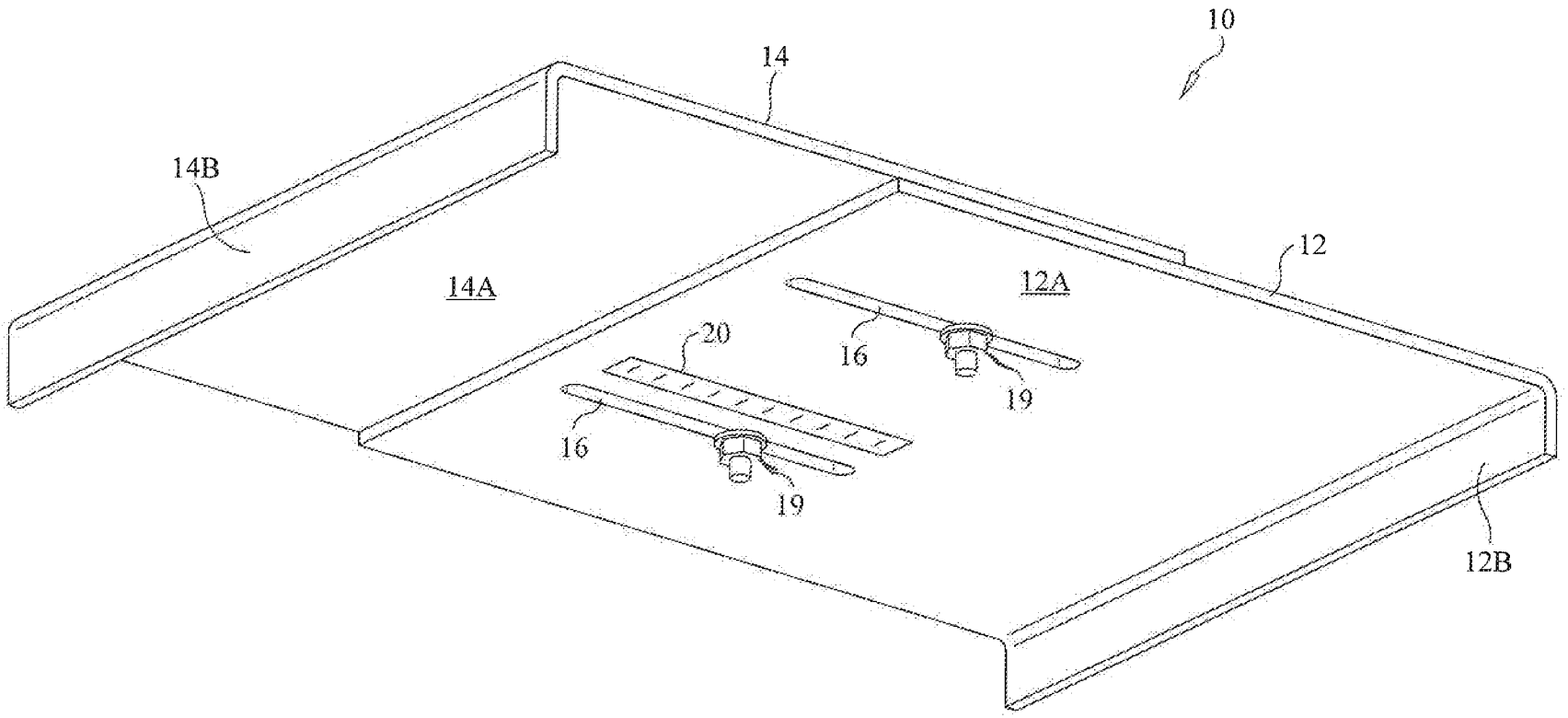
FIG. 2 is a bottom perspective view thereof.
Figure 3:
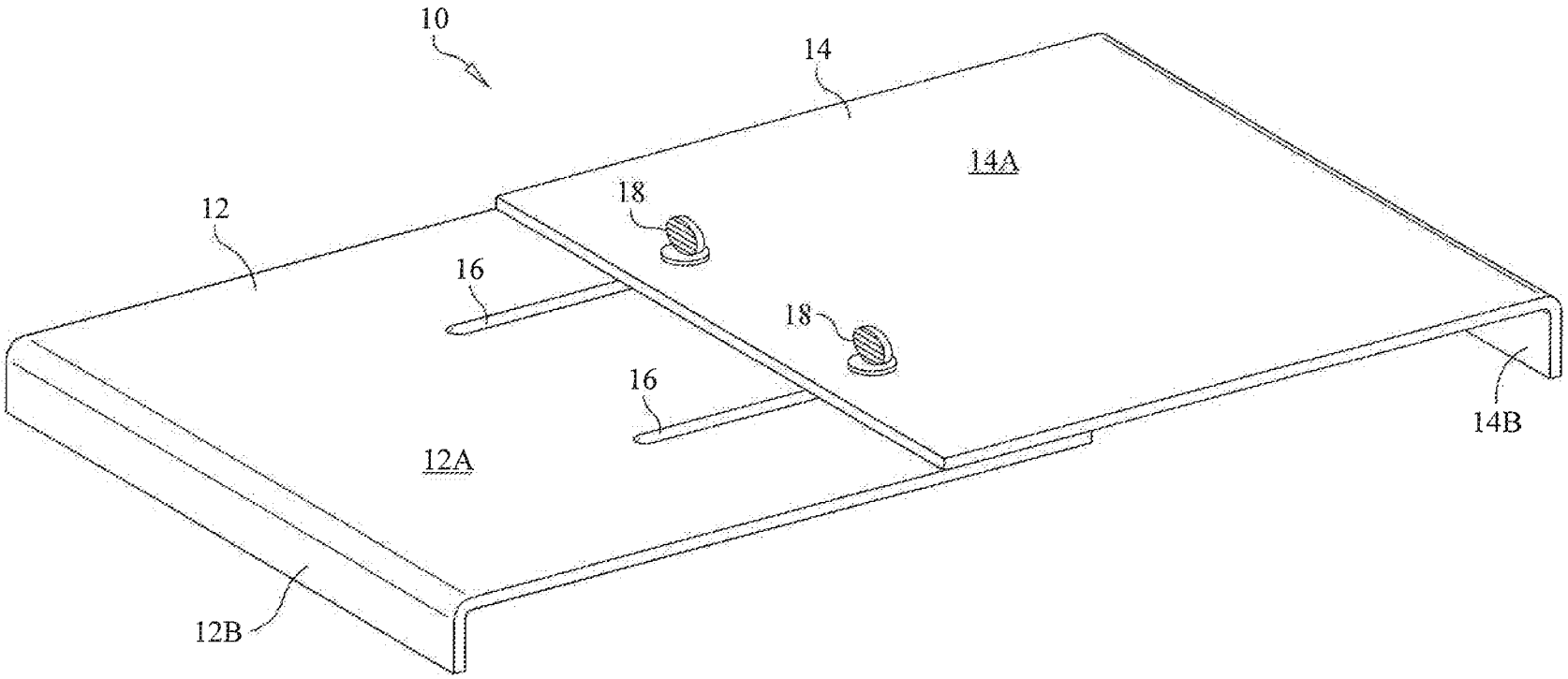
FIG. 3 is a top perspective view thereof in an elongated configuration.
Figure 4:
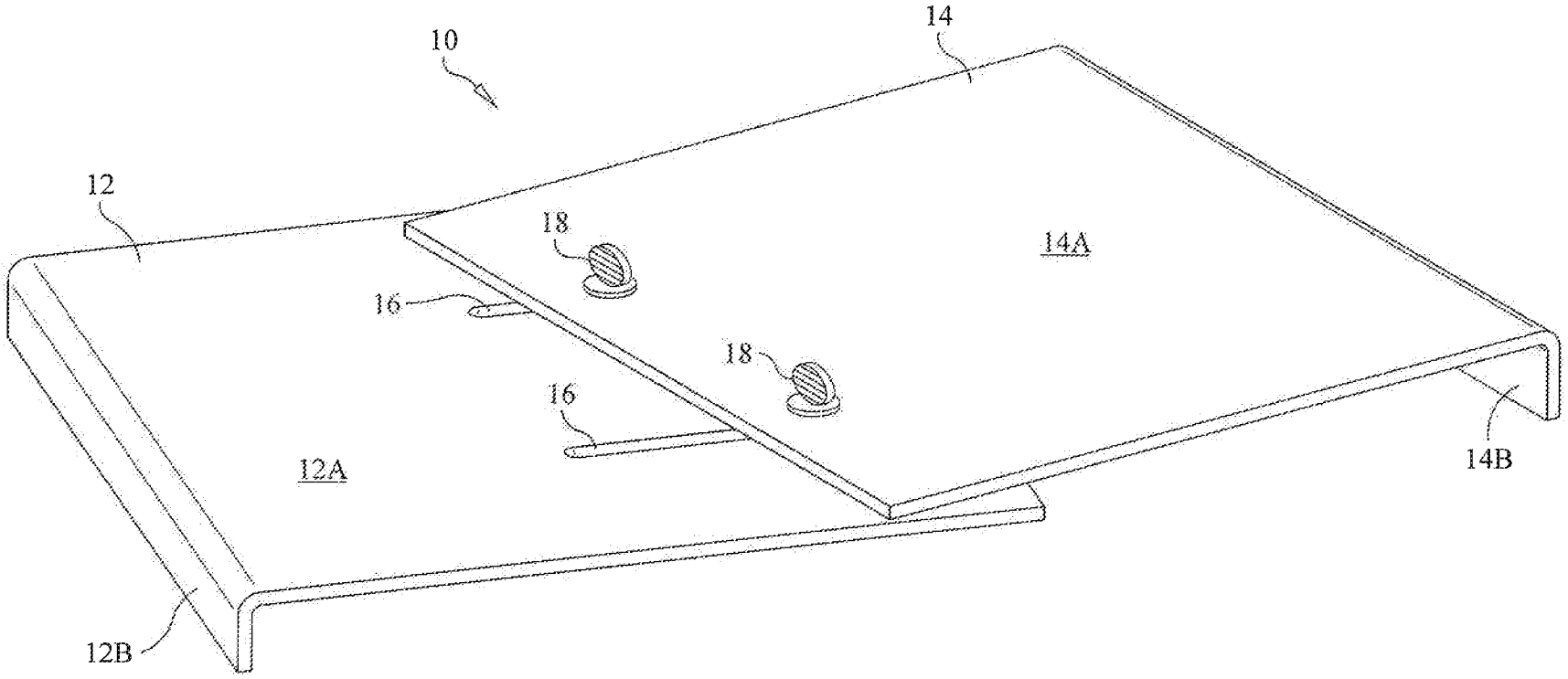
FIG. 4 is a top perspective view in an angled configuration.
Figure 5:
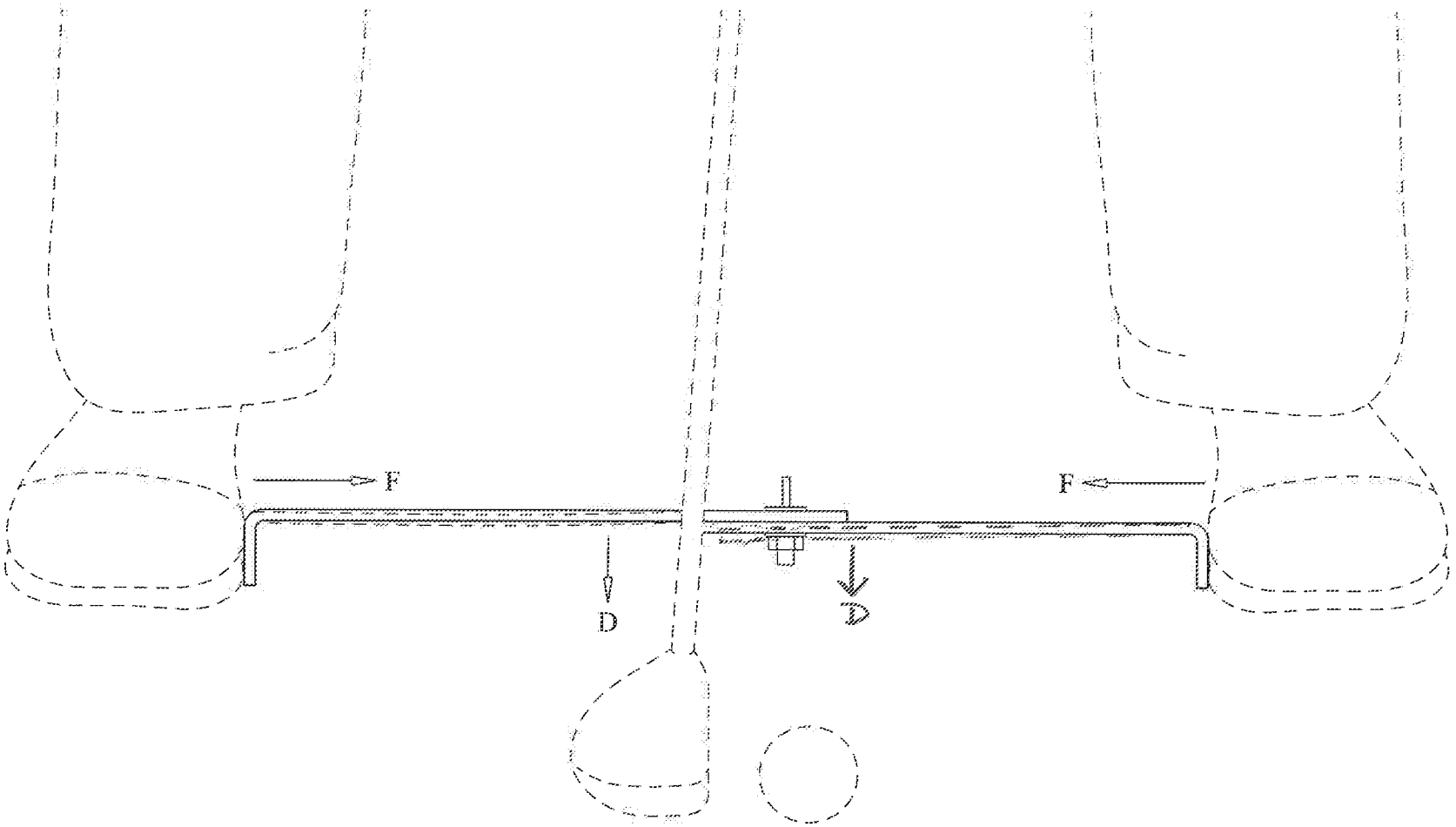
FIG. 5 is a front view illustrating the golf training apparatus in use by a golfer.

Turning now to the drawings, FIGS. 1-5 illustrate a golf training apparatus, generally referenced as 10, in accordance with the present invention. As more fully discussed herein below, golf training apparatus 10 is placed on the ground in-between a golfer's feet while the golfer is swinging a club and hitting golf balls as best illustrated in FIG. 5. When operatively placed, the apparatus is disposed between and in engagement with the instep (i.e. the area at the inside of the golfer's foot running between the big toe and the heel). Golf training device 10 includes an adjustable apparatus having first and second generally L-shaped panel members, referenced as 12 and 14 respectively. In a preferred embodiment, each panel member is fabricated from a polymer (i.e. plastic type material), however, any suitable natural or synthetic material is considered within the scope of the present invention. Panel members 12 and 14 are adjustably coupled to allow for user selected length longitudinal adjustment between retracted and extended configurations, and angular adjustment. FIG. 1 illustrates a partially retracted configuration and FIG. 3 illustrates a partially extended configuration.

Each panel member, 12 and 14, includes a generally planar top portion, referenced as 12A and 14A respectively, and terminates at one end thereof with a downwardly projecting leg, referenced as 12B and 14B respectively. The transition between planar top portions (12A and 14A) and legs (12B and 14B) is preferably a radiused bend to ensure comfort when engaged by the golfer's feet. In a first embodiment, the length of the device when measured from leg 12B to leg 14B will generally range between approximately 14-inches and 20-inches, a width measured from front to back between approximately 8-inches and 14-inches deep, a panel thickness of approximately ¼-inch, and legs 12B and 14B extending downward between approximately ½-inches to 2-inches. In one embodiment, device 10 measures approximately 14-inches long when fully retracted, and approximately 18-inches long when fully extended. As should be apparent, to accommodate golfers of different heights, statures, and the personal preference of the individual golfer, such dimensions are not limited and may be changed within the scope of the invention.

A significant aspect of the present invention involves providing a golf training apparatus that is adjustable. In accordance with this aspect of the present invention panels 12 and 14 are adapted for telescopic adjustment. More particularly, the planar top portion 12A of panel 12 defines a pair of parallel slotted apertures, each referenced as 16. In addition, the planar top portion 14A of panel 14 is adapted with through bores, each of which receive a mechanical fastener, namely a thumb screw 18. As best illustrated in FIG. 2., each thumb screw 18 is received by and extends through one of slotted apertures 16, and is secured by a nut and washer, collectively generally referenced as 19, when the planar top portion 14A is coupled in slidable overlapping relation with planar top portion 12A. Loosening of thumb screws 18 allows for telescopic adjustment of the apparatus length, whereafter tightening of thumb screws 18 enables apparatus 10 to be fixed at the user-determined length. While the golf training apparatus is illustrated as using thumb screw fasteners to affix the panel members in the selected configuration, any suitable fastening structure, including clips, lead screws, or ratchet mechanisms, may be used. The length adjustment feature is illustrated in FIG. 1 (partially retracted length) and FIG. 3 (extended length). A further advantage of length adjustability is the ability to configure apparatus 10 into a compact configuration which greatly increases use and portability.

A second significant aspect of the present invention involves providing a golf training apparatus that is also angularly adjustable for use with golf stances where the golfer's feet are not in parallel alignment. In accordance with this aspect of the present invention, slotted apertures 16 and thumb screws 18 allow panels 12 and 14 to be disposed in a range of angularly disposed configurations as best seen in FIG. 4. In a preferred embodiment, panels 12 and 14 may be angularly configured between a first configuration having an angle of 0-degrees (i.e. wherein panels 12 and 14 are longitudinally aligned), and a second configuration wherein panels 12 and 14 are disposed in an angular configuration (when viewed from above) of approximately 45-degrees.

A third significant aspect of the present invention involves the structure of panel members 12 and 14, and particularly top planar portions 12A and 14A, to form a semi-rigid structure that is capable of deflection in response to compressive force applied to the legs 12B and 14B by the instep portion of the user's feet. The degree of deflection may vary depending upon the resiliency and/or thickness of material used to fabricate panel members 12 and 14, as well as the length of legs 12B and 14B. It has been found that the deflection capability is important in providing the golfer with tactile feedback that is not realized with the use of a fully rigid structure.

The method of the present invention is that it relates to a golf training apparatus 10 structure that is bent on two ends. As best seen in FIG. 5, apparatus 10 is designed to be placed in-between a golfer's feet while the golfer is swinging a golf club. Apparatus 10 functions to solve the problem of golfers being unable to apply ideal foot pressure and ideal lower body force in ideal directions during their golf swing. Apparatus 10 provides resistance and feedback to the golfer during the swing as compressive force "F" applied by the golfer's feet causes deflection "D" or a bowing (illustrated in broken line) of the apparatus in proportion to the amount of force applied. Accordingly, golf training apparatus 10 trains golfers to apply ideal lower body forces in ideal directions to improve both accuracy, power, and balance in the golf swing. It is designed to be used both by placing the bend edges on the ground or facing up.

Golf training apparatus 10 also provides an easy and inexpensive way for the static position of the golfer as the ball is addressed. The device checks and reinforces use of a properly aligned stance, with the correct body position for playing the ball. In addition, as illustrated in FIG. 2, length measurement indica, referenced as 20, may be disposed on golf training apparatus 10, to assist the user in achieving precise and repeated length settings. The invention is used for practice and familiarizes a golfer with the correct footwork and golf stance and reinforces the golfer's knowledge of that correct position.

Figure 6:
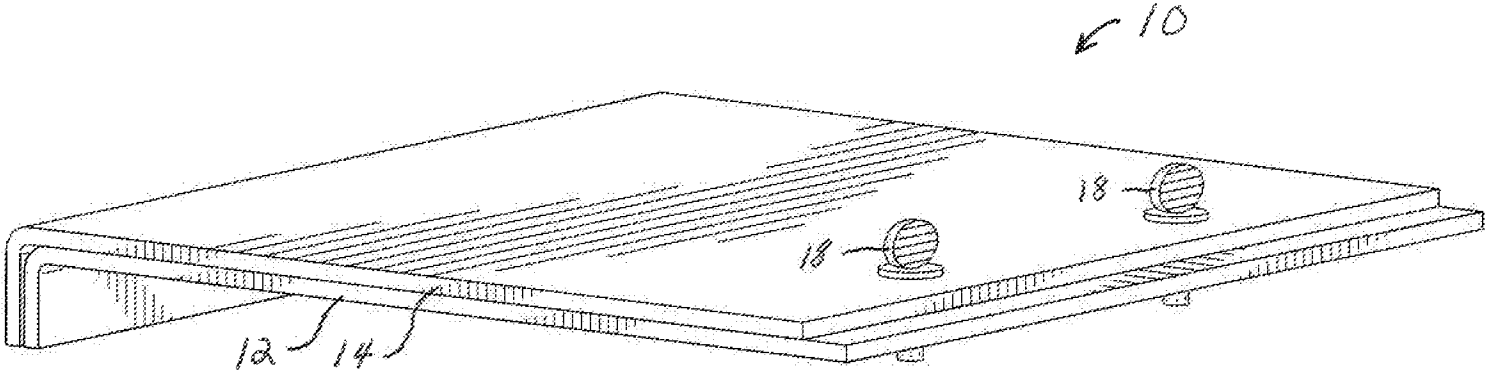
FIG. 6 is a perspective view illustrating the golf training apparatus in a compact nested configuration.

Still another important aspect of the present invention relates to portability. More particularly, as best illustrated in FIG. 6, golf training apparatus 10 is adapted to be configured to a compact configuration to ease of transport. Apparatus 10 is configured for transport by removing thumb screw fasteners 18 and re-arranging panel members 12 and 14 into the nested configuration illustrated in FIG. 6 and securing the panel members in the compact configuration using thumb screw fasteners 18. When configured in the compact configuration apparatus 10 measures approximately 10.5-inches long×10.5-inches wide.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A golf training apparatus which is placed on the ground between the golfer's feet in engagement with the instep of each foot when in use, said apparatus comprising:

first and second panel members adjustably coupled in overlapping relation to allow for user selected length adjustment between retracted and extended configurations;

each panel member includes a generally planar top portion terminating at one end thereof at a radiused bend extending to an integrally formed downwardly projecting leg;

each downwardly projecting leg extending continuously from front to back of said apparatus on opposing ends thereof such that each of said legs engage one foot instep of the golfer in use;

a mechanical fastener for fixing said first and second panels in one of said retracted and extended configurations;

said first and second panel members being telescopically and angularly adjustable and fixed in a user selected configuration by said at least one mechanical fastener.

2. The golf training apparatus of claim 1 wherein said first and second panel members are configurable in a compact nested configuration.

3. A golf training apparatus which is placed on the ground between the feet of a golfer in engagement with the golfer's instep when in use, said apparatus comprising:

first and second panel members, each panel member including a horizontal planar top portion having one end terminating at a radiused bend and a leg extending downward from said radiused bend;

said first and second panel members configurable between a use configuration wherein said panel members are coupled in overlapping relation with said legs disposed on opposing ends thereof defining planar surfaces in engagement with the golfer's instep, and a compact configuration wherein said panel members are coupled in overlapping relation with said legs disposed in adjacent relation;

said first and second panel members being telescopically adjustable in said use configuration; and said first and second panel members being angularly adjustable in said use configuration.

4. The golf training apparatus according to claim 3 further including length measurement indicia.

* * * * *